US006675725B2

(12) United States Patent
Felton et al.

(10) Patent No.: US 6,675,725 B2
(45) Date of Patent: Jan. 13, 2004

(54) SHELF AND SHELF SUPPORT

(75) Inventors: J. Reed Felton, Wauwatosa, WI (US); Douglas G. Lawrence, Sauxville, WI (US)

(73) Assignee: Versatile Products LLC, Menomonee Falls, WI (US)

( * ) Notice: Subject to any disclaimer, the term of this patent is extended or adjusted under 35 U.S.C. 154(b) by 0 days.

(21) Appl. No.: 09/870,359

(22) Filed: May 30, 2001

(65) Prior Publication Data

US 2002/0043187 A1 Apr. 18, 2002

Related U.S. Application Data

(63) Continuation-in-part of application No. 09/336,899, filed on Jun. 21, 1999, now Pat. No. 6,205,934, which is a continuation-in-part of application No. 09/209,501, filed on Dec. 11, 1998, now Pat. No. 6,053,115.

(51) Int. Cl.[7] ..... A47B 9/00

(52) U.S. Cl. ..... 108/107; 108/110

(58) Field of Search ..... 108/107, 108, 108/106, 110, 144.11, 147.16, 147.17; 211/187, 190, 191, 200, 207, 193; 248/241, 243, 220.21, 221.12

(56) References Cited

U.S. PATENT DOCUMENTS

| | | | | |
|---|---|---|---|---|
| 597,186 | A | | 1/1898 | Hunter |
| 605,291 | A | | 6/1898 | Hunter |
| 810,545 | A | | 1/1906 | Krag |
| 1,080,203 | A | | 12/1913 | Dungan |
| 1,742,069 | A | | 12/1929 | Greenwald et al. |
| 1,990,756 | A | | 2/1935 | Saaf |
| 2,042,517 | A | | 6/1936 | Ellis |
| 2,346,430 | A | | 4/1944 | Hauser |
| 2,700,476 | A | | 1/1955 | Maintain |
| 2,772,846 | A | | 12/1956 | Skar |
| 3,113,818 | A | | 12/1963 | Armeatrout |
| 3,266,635 | A | | 8/1966 | McConnell |
| 3,273,720 | A | | 9/1966 | Seiz |
| 4,901,965 | A | * | 2/1990 | Bowman |
| 5,054,404 | A | * | 10/1991 | Melgers |
| 5,127,340 | A | | 7/1992 | Maro et al. |
| 5,269,599 | A | | 12/1993 | Moring |
| 5,406,894 | A | * | 4/1995 | Herrmann et al. |
| 5,607,070 | A | | 3/1997 | Hellyer |
| 5,816,419 | A | | 10/1998 | Lamson |
| 5,868,263 | A | | 2/1999 | McAllister et al. |
| 5,921,190 | A | * | 7/1999 | Wood |
| 6,026,752 | A | | 2/2000 | Zachrai |
| 6,053,115 | A | * | 4/2000 | Felton |
| 6,202,570 | B1 | * | 3/2001 | Kurtsman |
| 6,205,934 | B1 | * | 3/2001 | Felton et al. |

FOREIGN PATENT DOCUMENTS

| | | | |
|---|---|---|---|
| DE | 1 290 688 | | 3/1969 |
| DE | 3637414 | A1 * | 5/1988 |
| FR | 2 763 226 | | 11/1989 |
| GB | 23061 | | 9/1912 |
| GB | 23063 | | 10/1912 |
| GB | 796180 | | 6/1958 |
| GB | 798106 | | 7/1958 |
| GB | 1320188 | | 1/1962 |
| GB | 9205514.4 | | 9/1993 |

* cited by examiner

*Primary Examiner*—Jose V. Chen
(74) *Attorney, Agent, or Firm*—Quarles & Brady, LLC

(57) ABSTRACT

A shelving assembly including at least one shelf member and at least one upright frame member wherein the frame member includes at least vertically arranged couplers and the shelf member includes two other vertically arranged couplers on one lateral edge where the couplers on either the shelf member or frame member include pins and the couplers on the other of the shelf and frame member include slot delineators and where the slot delineators open in the same direction so that, with the pins received within the slot delineators, the shelf member can be detached from the frame member by moving the shelf member in directions perpendicular to pin axis.

24 Claims, 7 Drawing Sheets

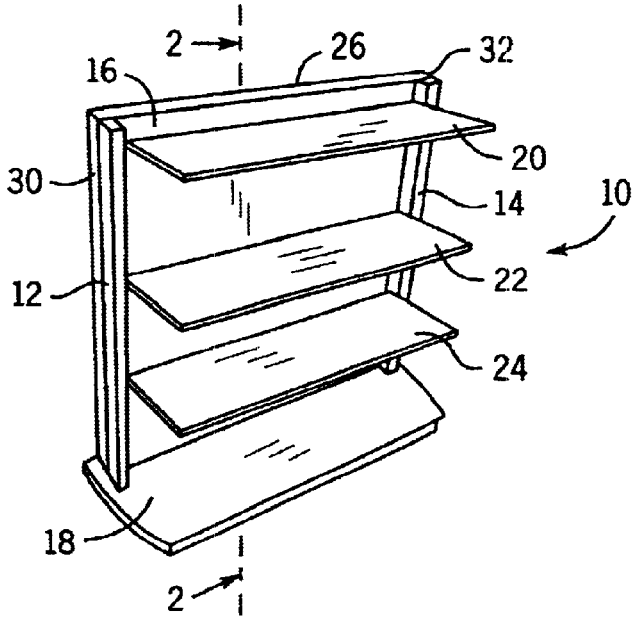
FIG. 1
FIG. 2
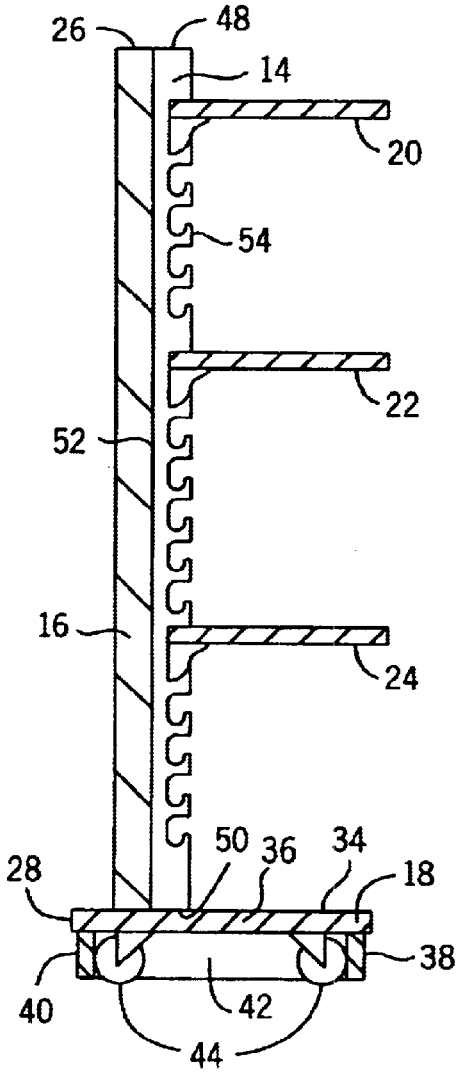

FIG. 4
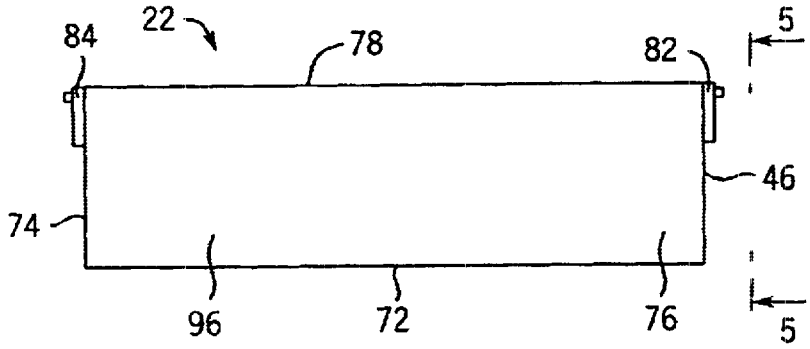
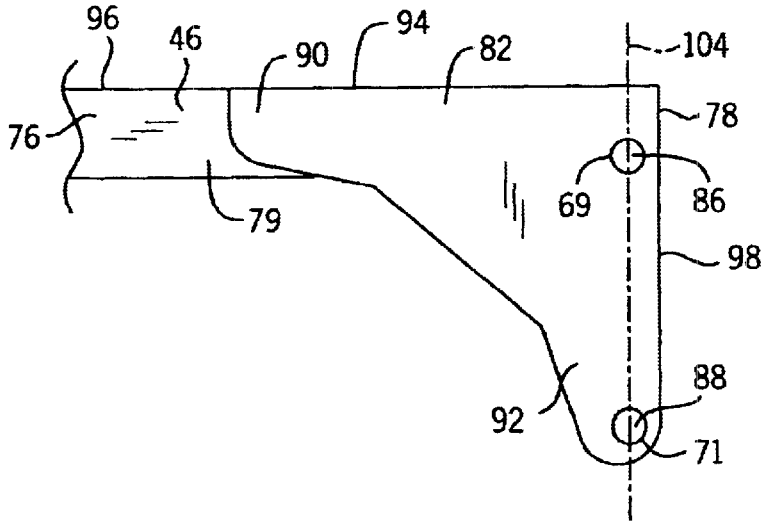
FIG. 5
FIG. 6
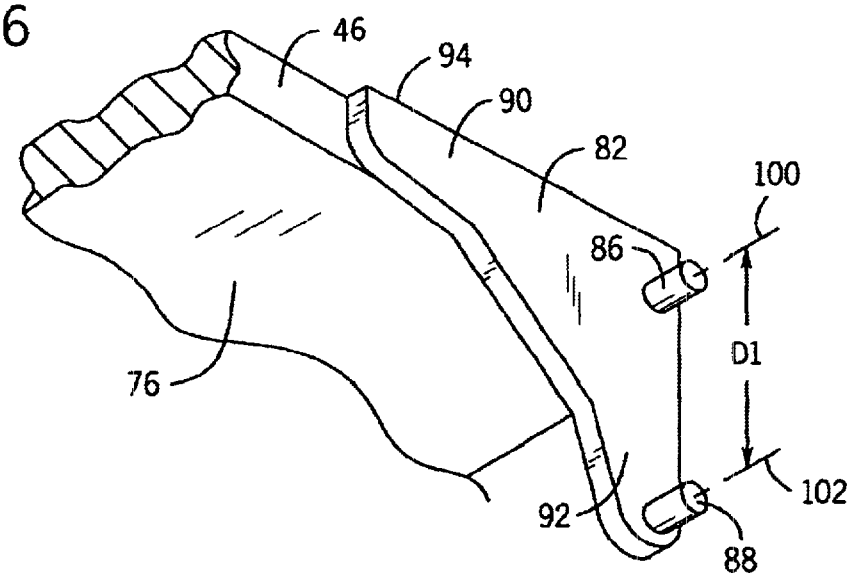

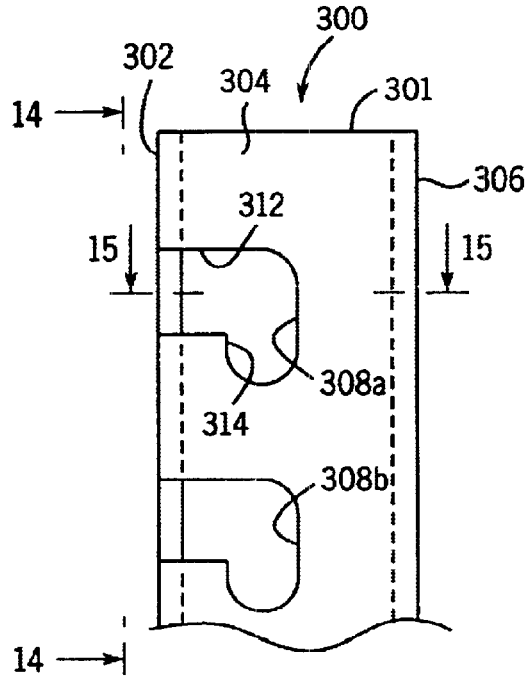
FIG. 13
FIG. 14
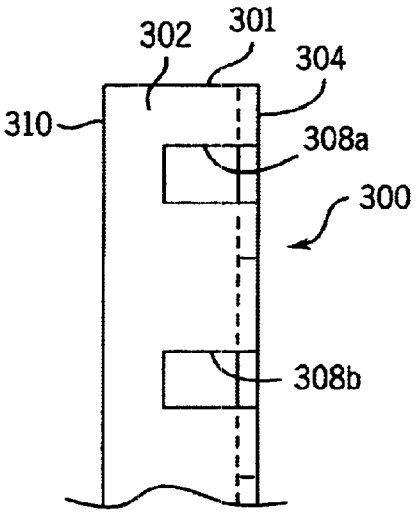
FIG. 15
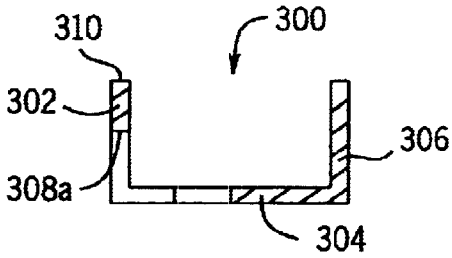

SHELF AND SHELF SUPPORT

CROSS-REFERENCE TO RELATED APPLICATIONS

This application is a continuation-in-part of U.S. patent application. Ser. No. 09/336,899 entitled "Support And Related Shelf" which was filed on Jun. 21, 1999 now U.S. Pat. No. 6,205,934 which was a continuation-in-part of Ser. No. 09/209,501 U.S. Pat. No. 6,053,115 entitled SUPPORT AND RELATED SHELF which was file on Dec. 11, 1998. Each of the above-referenced patents and applications is incorporated herein by reference.

STATEMENT REGARDING FEDERALLY SPONSORED RESEARCH OR DEVELOPMENT

Not applicable.

BACKGROUND OF THE INVENTION

This invention relates generally to racks and rack-type supports having horizontal planar surfaces and, more particularly, to such racks and supports of the type having removable and adjustable shelves.

A wide variety of racks and rack-type supports are known. Examples of but a few types are disclosed in U.S. Pat. No. 1,805,989 (Levene), U.S. Pat. No. 1,990,756 (Saaf), U.S. Pat. No. 5,127,340 (Maro et al.) and U.S. Pat. No. 5,607,070 (Hellyer). While these arrangements have been generally satisfactory for their intended purposes, they are not without disadvantages for certain applications.

For example, the shelves disclosed in the Levene patent must be bolted in place and unbolted to be removed and, if desired, stored. Where time has value, as is usually the case in a work environment, the arrangement is cumbersome. While the shelves disclosed in the Saaf patent may be more quickly mounted and removed, that convenience requires a shelf having pins mounted for pivoting movement into and out of supporting holes.

For greatest flexibility in erection, use and "tear-down, a scaffold should have a shelf-like platform which can be readily mounted and, just as readily, removed. Home entertainment centers, another type of product having one or more shelves, are most preferably configured so that the vertical spacing between shelves can be selected consistent with the vertical height of the components, e.g., tuner, compact-disc player, amplifier or the like, which are intended to rest upon such shelves. Structures like that disclosed in the Levene patent do not lend themselves easily to such uses.

Another type of rack with one or more shelves is embodied as mounted or freestanding units used to display retail products for sale. Such units are often referred to in the industry as "store fixtures." Most preferably, store fixtures should be aesthetically attractive, permit easy reconfiguration for displaying any of a variety of types of products and have features easily adapted to integration of advertising graphics or the like.

U.S. Pat. No. 5,816,419 describes one display-type shelving unit which includes a plurality of shelves mounted to laterally spaced posts. Each shelf is mounted using two special brackets which cooperate with slots and recesses in the shelf to support the shelf in a horizontal position, to hang the shelf in an essentially vertical position, or to maintain the shelf in an angled position. While this solution facilitates quick and easy movement of each shelf among its three possible positions, this solution does not enable shelf removal, facilitate changing the vertical positions of each shelf and facilitate various other useful shelving arrangements.

Yet another product which advantageously includes one or more flat surfaces having adjustable height includes a flat-surface desk which may be used by multiple persons. For example, in factories which have more than one shift, often persons who use a desk during different shifts are different heights. To comfortably accommodate users having various heights it is advantageous to have an adjustable-height desk top.

In addition to the problems described above, many current shelving systems require relatively complex mechanical configurations to provide desired support. In addition to rendering these systems difficult to adjust, these complex mechanical configurations also increase the costs associated with manufacturing.

Moreover, in order to provide sufficient support for shelves that may be heavily weighted, often the support configuration tends to be obtrusive and therefore can be aesthetically displeasing. For instance, many shelf configurations include upright vertical support at each of four shelf corners to support the shelves without cantilever action. In addition to being aesthetically obstructive, upright supports hinder access to the shelving space.

Other "cantilevered" shelf configurations may include upright supports located proximate a rear shelf end along each of two lateral shelf edges. These cantilevered configurations, as the name implies, rely upon cantilever action requiring relatively wide upright supports so that shelves are cantilevered across a fulcrum member proximate a front edge of the upright supports with a back shelf end restrained by a member proximate a rear edge of the upright supports.

The wide uprights, while aesthetically more pleasing than assemblies requiring four upright supports, still block more of the lateral edges of shelves than is desirable. In addition, the process for manufacturing uprights having both fulcrums and restraining members proximate the front and rear edges of the uprights, respectively, is expensive.

For the reasons described above an improved support and shelf that is simple, relatively inexpensive to manufacture and aesthetically attractive would be advantageous.

BRIEF SUMMARY OF THE INVENTION

It has been recognized that an easily adjustable and extremely strong shelf assembly can be configured including relatively compact frame members that are inexpensive to produce and that minimally obstruct access to storage space on top of the shelves. To this end, the inventive assemblies include at least one shelf and frame members that are juxtaposed to lateral sides of the shelf. The frame members form vertically aligned coupler pairs and the shelf also includes vertically aligned coupler pairs at each lateral edge. The coupler pairs cooperate to maintain the shelf mounted to the frame members. One of the coupler pairs includes pins and the other includes slot delineators where the delineators form passageways for receiving the pins. Bearing surfaces on the pins and delineators cooperate to support the shelf. Importantly, because of the vertical alignment of the frame member couplers, the dimension of each frame member along the lateral edge of the shelf is minimal and therefore aesthetically unobtrusive.

An exemplary embodiment of the invention includes a shelving assembly comprising at least one shelf member that forms a back edge along a longitudinal axis, forms at least a first lateral edge and includes oppositely facing first and second shelf surfaces, the back edge being a shelf member receiving edge, at least one essentially upright support member including a support member receiving edge, a first coupler pair including first and second couplers mounted to the shelf member, the first and second couplers mounted such that the couplers are aligned along a coupler axis that is essentially perpendicular to the shelf surfaces and such that the first and second couplers are proximate the shelf member receiving edge, a second coupler pair including third and fourth couplers linked to the support member, the third coupler positioned essentially directly above the fourth coupler, one of the coupler pairs including first and second pins and the other of the coupler pairs including first and second slot delineators, the first and second pins formed about first and second pin axis and forming first and second bearing surfaces, respectively, the pin axis defining a first dimension there between, each delineator forming a passageway that opens in a first direction from an opening at the corresponding member's receiving edge to a distal end, the distal ends of the first and second delineators recessing in a second direction perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through, the first coupler pair bearing surfaces within a coupling plane, wherein, the shelf member is supportable by the support member with the first and second pins received in the first and second slot delineators, the first and second bearing surfaces contacting and bearing against the third and fourth bearing surfaces and the shelf surfaces essentially horizontally orientated.

In some embodiments the shelf member is mounted to the frame member, the passageways form paths perpendicular to the pin axis so that the shelf member is decouplable from the frame member by moving the shelf member in directions that are perpendicular to the pin axis.

In some embodiments the first coupler pair includes the first and second pins, the second coupler pair includes the fist and second slot delineators and the passageways open from the receiving edge of the support member and recess downwardly at the distal ends.

In several embodiments the shelf member further includes at least one brace member mounted to the lateral edge, extending perpendicular to one of the shelf surfaces and proximate the back edge and, wherein the first and second pins extend from the brace member. Here the first and second shelf surfaces may be top and bottom surfaces, respectively, the top surface may face upward when the shelf member is mounted to the support member and the brace member may extend from the bottom surface.

According to one aspect the support member forms a plurality of slot delineators along a vertical length of the support member and adjacent slot delineators are equispaced along the vertical length. The slot delineators may have essentially the same shape.

The support member may include at least first and second essentially upright wall members that form an essentially right angle where the first wall member forms the receiving edge and the passageways extends into the second wall member, the first direction essentially perpendicular to the receiving edge. The first wall member may include first and second edges, the first and second wall members are linked at the first edge and the support member further includes at least a third wall member linked to the first wall member at the second edge, the third wall member extending from the first wall member in the first direction and opposing the second wall member.

The third wall member may form an oppositely facing second coupler pair that is similar to the second coupler pair formed by the second wall member and that can be used to support a shelf member.

In many embodiments the shelf member forms a second lateral edge opposite the first lateral edge and wherein the assembly further includes a complimentary first coupler pair including complimentary first and second couplers mounted to the second lateral edge, the complementary first coupler pair couplers mounted such that the couplers are aligned along a complimentary coupler axis that is essentially perpendicular to the shelf surfaces and such that the complimentary coupler pair couplers are proximate the receiving edge, a complimentary support member opposite the at least one support member, a complimentary second coupler pair including complimentary third and fourth couplers linked to the complimentary support member, the complimentary third coupler positioned essentially directly above the complimentary fourth coupler and one of the complimentary coupler pairs including complimentary first and second pins and the other of the complimentary coupler pairs including complimentary first and second slot delineators, the complimentary first and second pins forming complimentary first and second bearing surfaces, each complimentary delineator forming a complimentary passageway that opens in the first direction from the corresponding member's receiving edge and extends to a distal end, the distal ends of the complimentary first and second delineators recessing in the second direction perpendicular to the first direction and defining complimentary third and fourth bearing surfaces, respectively, the complimentary first delineator passageway wide enough for the complimentary first pin to pass through and the complimentary second delineator passageway wide enough for the complimentary second pin to pass through, wherein, the shelf member is supportable by the support members with the complimentary first and second pins received in the complimentary first and second slot delineators, the complimentary first and second bearing surfaces contacting and bearing against the complimentary third and fourth bearing surfaces and the support surfaces essentially horizontally orientated.

In some embodiments, with the shelf member mounted to the support member, the shelf member extends from the support member in an extending direction and wherein the extending direction is opposite the first direction in which the passageway opens from the passageway opening to the distal end.

In other embodiments, with the shelf member mounted to the support member, the shelf member extends from the support member in an extending direction and wherein the extending direction is the same as the first direction in which the passageway opens from the passageway opening to the distal end.

In some embodiments the second coupler pair includes the first and second pins and the passageways open from the back edge of the shelf member and recess upwardly at the distal ends.

The invention also includes a support assembly comprising at least one supportable member that forms a back edge along a longitudinal axis, forms at least a first lateral end and includes oppositely facing first and second surfaces, the back edge being a supportable member receiving edge, at least one essentially upright support member including a support member receiving edge, a first coupler pair including first and second pins mounted to the supportable member, the first and second pins mounted such that the pins are aligned along a coupler axis that is essentially perpendicular to the support surfaces and such that the first and second couplers are proximate the supportable member receiving edge, the first and second pins formed about first and second pin axis and forming first and second bearing surfaces, respectively, the pin axis defining a first dimension there between, a second coupler pair including first and second slot delineators, the first slot delineator positioned essentially directly above the second slot delineator, each delineator forming a passageway that opens in a first direction from an opening at the support member receiving edge to a distal end, the distal ends of the first and second delineators recessing downward in a second direction that is essentially perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through, wherein, the supportable member is supportable by the support member with the first and second pins received in the first and second slot delineators respectively, the first and second bearing surfaces contacting and bearing against the third and fourth bearing surfaces, respectively, and the support surfaces essentially horizontally orientated.

Here, the supportable member may form a second lateral end opposite the first lateral end wherein the assembly further includes a complimentary first coupler pair including complimentary first and second pins mounted to the second lateral end, the complimentary first and second pins mounted such that the pins are aligned along a complimentary coupler axis that is essentially perpendicular to the support surfaces and such that the complimentary first and second pins are proximate the supportable member receiving edge, the complimentary first and second pins formed about complimentary first and second pin axis and forming complimentary first and second bearing surfaces, respectively, the complimentary first and second pin axis also defining the first dimension there between, a complimentary support member opposite the at least one support member, and a complimentary second coupler pair mounted to the complimentary support member, the complimentary second coupler pair including complimentary first and second slot delineators, the complimentary first slot delineator positioned essentially directly above the complimentary second slot delineator, each complimentary delineator forming a complimentary passageway that opens in the first direction from an opening at the complimentary support member receiving edge to a distal end, the distal ends of the complimentary first and second delineators recessing downward in the second direction that is essentially perpendicular to the first direction and defining complimentary third and fourth bearing surfaces, respectively, each complimentary passageway opening having a top edge, the top edges defining the second dimension, the complimentary first delineator passageway wide enough for the complimentary first pin to pass through and the complimentary second delineator passageway wide enough for the complimentary second pin to pass through, wherein, the supportable member is supportable by the support members with the complimentary first and second pins received in the complimentary first and second slot delineators respectively, the complimentary first and second bearing surfaces contacting and bearing against the complimentary third and fourth bearing surfaces, respectively, and the support surfaces essentially horizontally orientated.

The supportable member may be a bar, a shelf member, a hanging drawer or chest of drawers, etc.

The present invention further includes an assembly for use with at least one supportable member that forms a back edge along a longitudinal axis, forms at least a first lateral end and includes oppositely facing first and second surfaces, the back edge being a supportable member receiving edge, a first coupler pair including first and second pins mounted to the supportable member, the first and second pins mounted such that the pins are aligned along a coupler axis that is essentially perpendicular to the support surfaces and such that the first and second couplers are proximate the supportable member receiving edge, the first and second pins formed about first and second pin axis and forming first and second bearing surfaces, respectively, the pin axis defining a first dimension there between, the assembly comprising: at least one essentially upright support member including a support member receiving edge, a second coupler pair including first and second slot delineators, the first slot delineator positioned essentially directly above the second slot delineator, each delineator forming a passageway that opens in a first direction from an opening at the support member receiving edge to a distal end, the distal ends of the first and second delineators recessing downward in a second direction that is essentially perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through, wherein, the supportable member is supportable by the support member with the first and second pins received in the first and second slot delineators respectively, the first and second bearing surfaces contacting and bearing against the third and fourth bearing surfaces, respectively, and the support surfaces essentially horizontally orientated.

Here the assembly may also be useable where the supportable member forms a second lateral end opposite the first lateral end and with a complimentary first coupler pair including complimentary first and second pins mounted to the second lateral end, the complimentary first and second pins mounted such that the pins are aligned along a complimentary coupler axis that is essentially perpendicular to the support surfaces and such that the complimentary first and second pins are proximate the supportable member receiving edge, the complimentary first and second pins formed about complimentary first and second pin axis and forming complimentary first and second pin axis and forming complimentary first and second bearing surfaces, respectively, the complimentary pin axis also defining the first dimension there between, the assembly further including: a complimentary support member opposite the first support member, a complimentary second coupler pair mounted to the complimentary support member, the complimentary second coupler pair including complimentary first and second slot delineators, the complimentary first slot delineator positioned essentially directly above the complimentary second slot delineator, each complimentary delineator forming a complimentary passageway that opens in the first direction from an opening at the complimentary support member receiving edge to a distal end, the distal ends of the complimentary first and second delineators recessing downward in the second direction that is essentially perpendicular to the first direction and defining complimentary third and fourth bearing surfaces, respectively, each complimentary passageway opening having a top edge, the top edges defining the second dimension, the complimentary first delineator passageway wide enough for the complimentary first pin to pass through and the complimentary second delineator passageway wide enough for the complimentary second pin to pass through, wherein, the supportable member is supportable by the support members with the complimentary first and second pins received in the complimentary first and second slot delineators respectively, the complimentary first and second bearing surfaces contacting and bearing against the complimentary third and fourth bearing surfaces, respectively, and the support surfaces essentially horizontally orientated.

These and other advantages and aspects of the invention will become apparent from the following description. In the description, reference is made to the accompanying drawings which form a part hereof, and in which there is shown a preferred embodiment of the invention. Such embodiment does not necessarily represent the full scope of the invention and reference is made therefore, to the claims herein for interpreting the scope of the invention.

BRIEF DESCRIPTION OF THE SEVERAL VIEWS OF THE DRAWINGS

FIG. 1 is a perspective view of a shelving system according to the present invention;

FIG. 2 is a partial cross-sectional view taken along line 2—2 of FIG. 1;

FIG. 4 is a top plan view of one of the shelves of FIG. 1;

FIG. 5 is a side elevational view taken along the line of 5—5 of FIG. 4;

FIG. 6 is a perspective view of the portion of the shelf illustrated in FIG. 5;

FIG. 13 is a side elevational view of an advantageous frame member;

FIG. 14 is a side elevational view taken along the line 14—14 of FIG. 13; and FIG. 15 is a cross sectional view taken along the line 15—15 of FIG. 13.

DETAILED DESCRIPTION OF THE INVENTION

Figure 3:
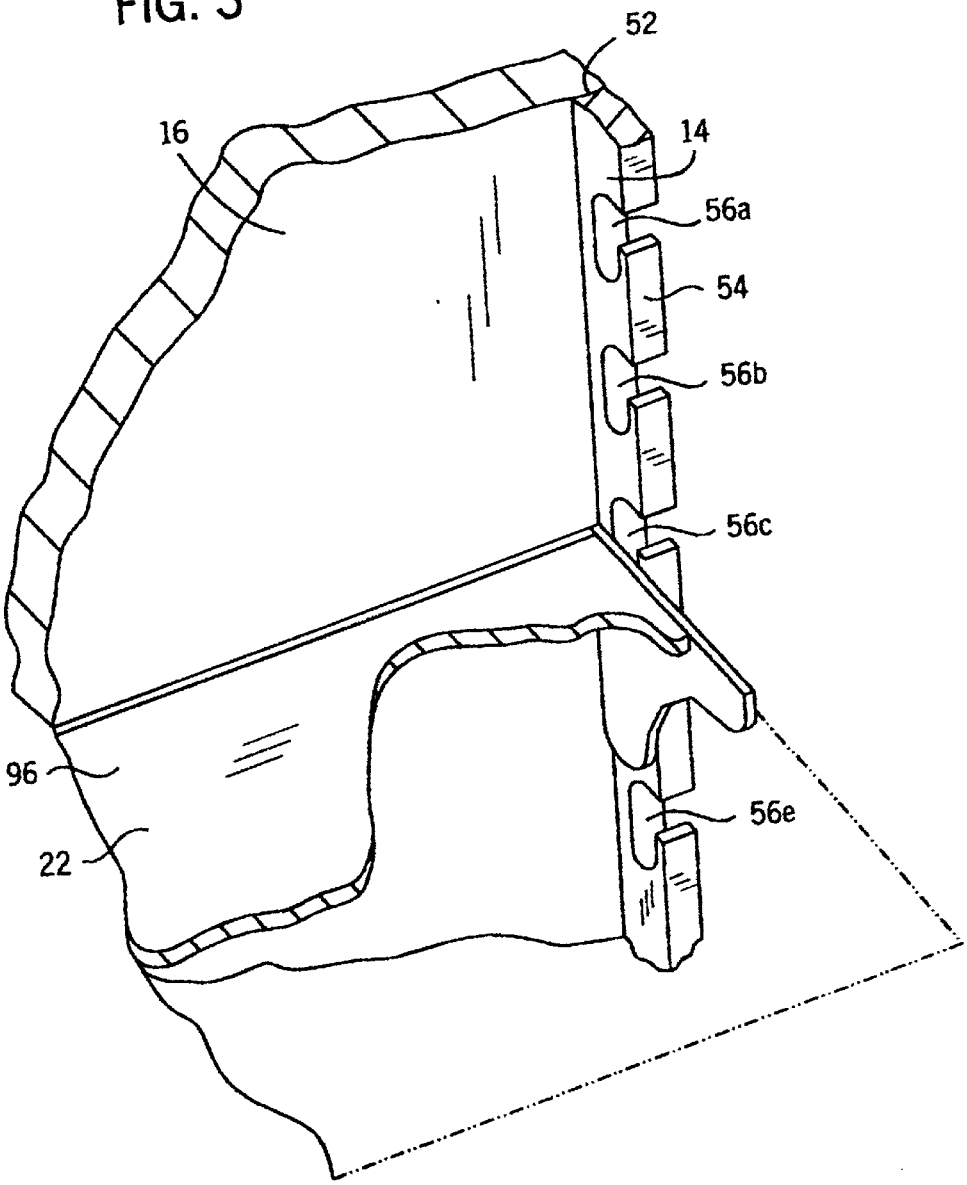
FIG. 3 is a partial cross-sectional view of a portion of the assembly of FIG. 1.

Referring now to the drawings wherein like reference characters represent similar components throughout the several views and, specifically, referring to FIGS. 1 and 2, the present invention will be described in the context of an exemplary shelving system 10 including first and second essentially upright frame members 12 and 14, a back wall member 16, a base assembly 18 and a plurality of shelf assemblies 20, 22 and 24.

Base assembly 18 includes a ridged essentially rectilinear horizontal member 34 that forms an upward facing surface 36, a plurality of skirt forming walls 38, 40 and 42 (see FIG. 2) and a plurality of swiveling wheels 44 (only two illustrated). Wheels 44 are mounted to the under surface of horizontal member 34 providing support for the assembly thereabove and allow the assembly thereabove to be moved relatively easily. Members 38, 40 and 42 are also mounted to the under surface of horizontal member 34 and, along with member 34, form a downwardly opening box about wheels 44 to conceal the wheels there within.

Referring also to FIG. 3, back wall member 16 is a flat ridged planar member having top and bottom ends 26 and 28, respectively, and first and second lateral edges 30 and 32, respectively. The bottom end 28 of back wall member 16 is securely mounted to top surface 36 of member 34 so that wall member 16 is essentially vertically aligned as illustrated.

Each of shelf members 20, 22 and 24 have an essentially identical construction and therefore, in the interest of simplifying this explanation, only shelf member 22 will be described here in detail. Similarly, each of frame members 12 and 14 have an essentially identical configuration and operation, construction, hardware and concepts related thereto will only be described in the context of frame member 14. Furthermore, referring to FIGS. 1 and 4, opposite ends of shelf member 22 have essentially identical constructions and operate in essentially the same manner and therefore, unless indicated otherwise, only end 46 that cooperates with frame member 14 to support shelf member 22 in a horizontal position (see FIG. 1) will be explained here in detail.

Figure 7:
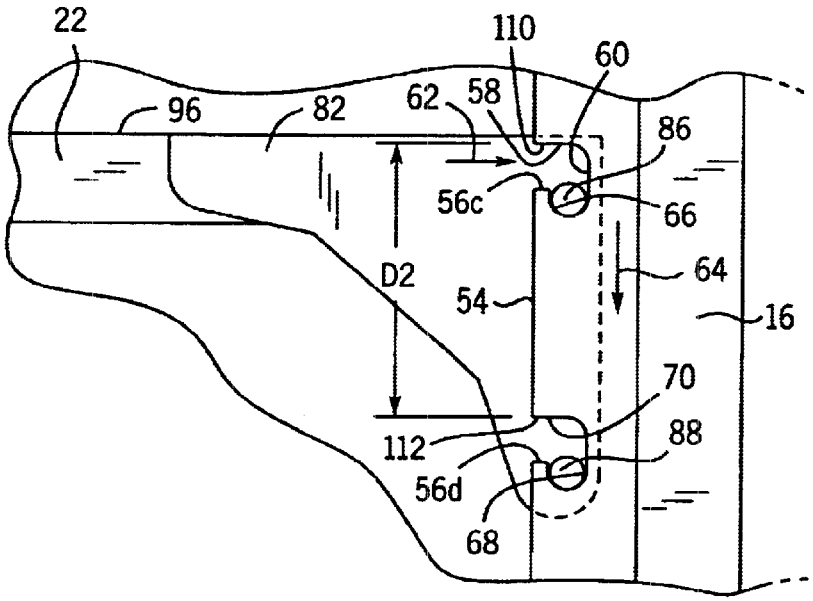
FIG. 7 is a side elevational view of the cooperating portions of one of the shelves and a supporting frame member of FIG. 1.

Referring now to FIGS. 2 and 3, frame member 14 is a ridged elongated member having a top end 48, a rear edge 52 and a receiving edge 54 that faces in a direction opposite rear edge 52. Frame member 14 forms a plurality of couplers that are equally spaced along its length. In this embodiment, the couplers are in the form of slot delineators referred to by numeral 56 followed by a lowercase letter that distinguishes one slot delineator from another. For example, in FIG. 3, four of the illustrated slot delineators are identified by numerals 56*a*, 56*b*, 56*c* and 56*e*. Referring also to FIG. 7, slot delineator 56*c* and another slot delineator 56*d* can be observed in side prospective view. Each of the delineators is essentially identical and therefore, unless indicated otherwise, only delineator 56*c* will be described in detail.

Delineator 56*c* forms a passageway 58 that opens from the member receiving edge 54 to a distal end 60 along a first direction identified by arrow 62 that is perpendicular to the surface defined by edge 54. At distal end 60, delineator 56*c* recesses downwardly in a direction that is identified by arrow 64 and that is essentially perpendicular to the first direction 62. Within the recessed portion of passageway 58, delineator 56*c* forms a bearing surface 66 for receiving a pin (described in more detail below) to support one of the shelf assemblies. Delineator 56*d* also forms a passageway 70 that is essentially identical to passageway 58 except that passageway 70 is spaced below passageway 58. Delineator 56*d* forms another bearing surface 68 within a recessed distal portion of passageway 70.

Referring now to FIGS. 2 through 6, shelf assembly 22 includes a shelf member 76, first and second brace members 82 and 84 and two shelf assembly coupler pairs. Shelf member 76 is an essentially ridged, rectilinear and planar member having first and second lateral edges 46 and 74, respectively, a front edge 72 and a rear edge 78 which is also referred to as a shelf member receiving member 78. Shelf member 76 forms oppositely facing shelf surfaces including a top shelf surface 96 and a bottom shelf surface 79.

As indicated above, the configurations of shelf member 76 at each of lateral edges 46 and 74 is essentially identical and therefore, only the configuration at edge 46 that cooperates with frame member 14 will be described in detail.

Referring still to FIGS. 2 through 6, brace member 82 is an essentially flat, rigid member including first and second sections 90 and 92 that are integrally connected and that have flat edges 94 and 98 where edges 94 and 98 form an essentially 90° angle. Brace member 82 is securable to lateral edge 46 so that extending member 90 extends at least in part along the length of edge 46 with top edge 94 flush with the top surface 96 of shelf member 76 and a rear edge 98 of member 82 flush with shelf member receiving edge 78. Thus, when secured to shelf member 76, brace member 82 is positioned adjacent the receiving edge 78.

Referring still to FIGS. 2 through 6, each pin member 86 and 88 has an essentially annular or cylindrical shape and is formed about a separate pin axis 100 and 102, respectively (See FIG. 6). Coupler 86 forms a bearing surface 69 while coupler 88 forms another bearing surface 71. Couplers 86 and 88 are integrally secured to brace member 82 and extend laterally therefrom. Pins 86 and 88 are secured to brace member 82 such that they are aligned along a coupler axes 104 which is essentially perpendicular to surface 92. In addition, pins 86 and 88 are secured such that they are spaced apart and their axes 100 and 102 define a first dimension D1 as illustrated in FIG. 6.

Referring again to FIG. 7, each of slot delineators 56*c* and 56*d* includes a top edge 110 and 112, respectively, at the top of a corresponding passageway 60 and 70, respectively. The top edges 110 and 112 of adjacent delineators 56*c* and 56*d* define a second dimension D2 which is essentially identical to dimension D1.

Referring still to FIGS. 1 through 7, to mount shelf assembly 22 between frame members 12 and 14, a system user grasps shelf assembly 22 at front end 72 and holds assembly 22 such that shelf surface 96 is facing upward and is essentially horizontal. The system user aligns pins 86 and 88 with the openings to passageways 58 and 70. Note that because dimensions D1 and D2 are essentially identical, pins 86 and 88 should be simultaneously receivable within the openings to passageways 58 and 70, respectively. Next, the user moves shelf assembly 22 back toward wall member 16 until pins 86 and 88 are within passageways 58 and 70 and at distal ends (i.e. 60) of the passageways, respectively.

The shelf assembly 22 is then lowered such that pins 86 and 88 are received within the recessed portions of the passageway distal ends as illustrated in FIG. 7. In this position, first and second bearing surfaces 69 and 71 that correspond to pins 86 and 88, respectively, bear against third and fourth bearing surfaces 66 and 68 corresponding to slot delineators 56*c* and 56*d*, respectively, and shelf assembly 22 is maintained in a horizontal position.

As indicated above, complimentary member 12 is similar to member 14 and the shelf assembly includes complimentary hardware similar to the hardware described above for cooperating with member 12 (e.g., complimentary pins, delineators, axis, braces, bearing surfaces, etc.). Thus, reference should be made to the component descriptions above for an understanding of the complimentary components.

Figure 8:
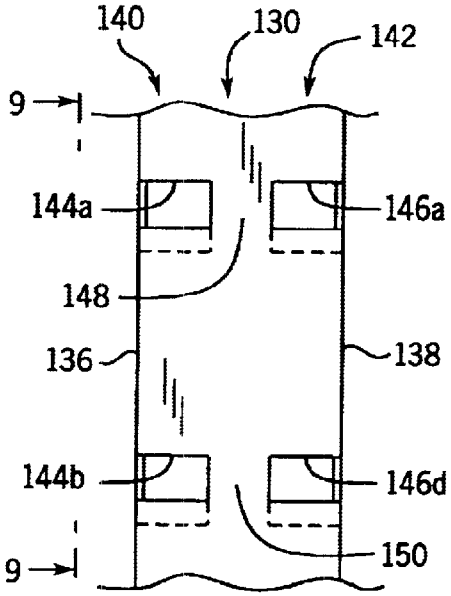
FIG. 8 is a front elevational view of a center frame member according to the present invention.
Figure 9:
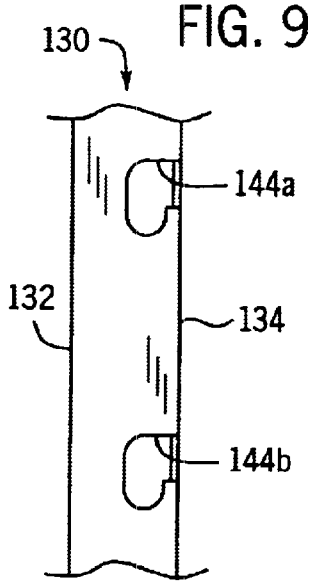
FIG. 9 is a side elevational view taken along the line 9—9 of FIG. 8.

While the embodiment described above includes two separate frame members (e.g., 12 and 14) for supporting shelves there between, the invention also contemplates at least one embodiment where a plurality of adjacent shelf assemblies are to be configured and a single frame member may be positioned between two adjacent shelving assemblies to perform support duties for each of two adjacent shelves. To this end, referring to FIGS. 8 and 9, a center frame member 130 for positioning between shelf assemblies (e.g., 22 in FIGS. 1 through 7) is illustrated. Member 130 is an essentially upright ridged member including a rear edge 132, a frame member receiving edge 134 that is opposite rear edge 132 and first and second lateral edges 136 and 138, respectively. Member 130 is similar to member 14 described above except that, instead of forming a single column of slot delineators, member 130 forms first and second columns of slot delineators 140 and 142, respectively. Column 140 includes a plurality of slot delineators (only two shown) including delineators 144*a* and 144*b*. Similarly, column 142 includes a plurality of slot delineators (only two illustrated) including first and second delineators 146*a* and 146*b*. Spacer members 148 and 150 are provided between adjacent delineators 144*a* and 146*a* and between delineators 144*b* and 146*b*, respectively.

The shapes, spacing and operation of the delineators formed by member 130 are essential identical to the shapes, spacing and operation of delineators 56*a*, etc., described above and therefore, will not be described here again in detail. It should be sufficient to say that member 130 is useful with other support members to support shelves on either side of member 130. This design is simple and reduces manufacturing costs.

Figure 10:
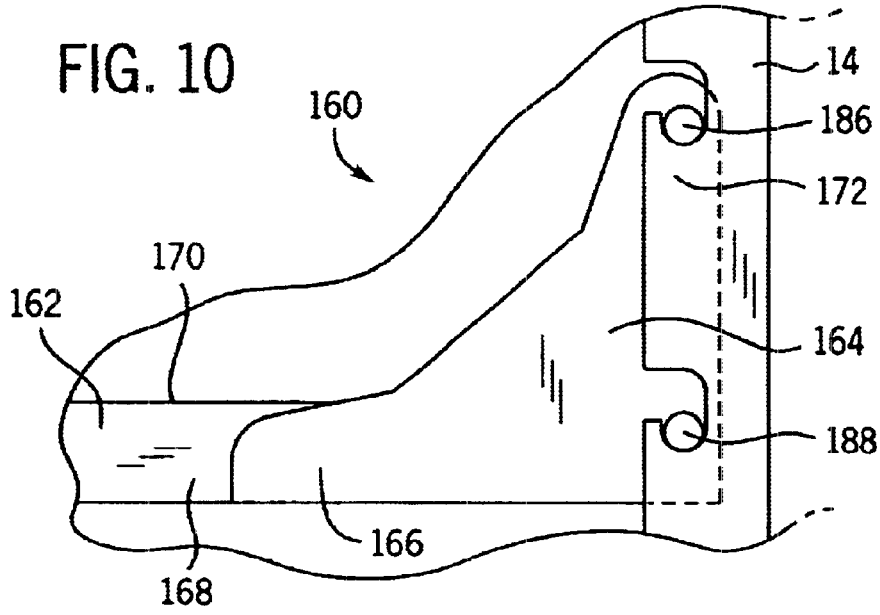
FIG. 10 is a view similar to that of FIG. 7, albeit of another embodiment of the present invention.

Referring now to FIG. 10, another embodiment 160 of the present invention is illustrated. Embodiment 160 is similar to the first embodiment described above and therefore, only unique aspects of embodiment 160 will be described in detail. For a better understanding of elements of embodiment 160 that are not explained here, references made to the description above.

In embodiment 160, frame member 14 is essential identical to frame member 14 described above. Shelf assembly 162 is similar to the shelf assembly 22 described above, except that brace members (only one shown) 164 are effectively inverted so that a first extension 166 of brace member 164 extends at least in part along the length of a shelf member lateral edge 168 while the other extension 172 extends upwardly from a top support surface 170 (as opposed to extending downward from a bottom surface). Pins 186 and 188 are arranged and positioned in a similar fashion to those described above with respect to the first embodiment. Thus, the brace members may extend from either the top or the bottom support surfaces of the shelf member.

Figure 11:
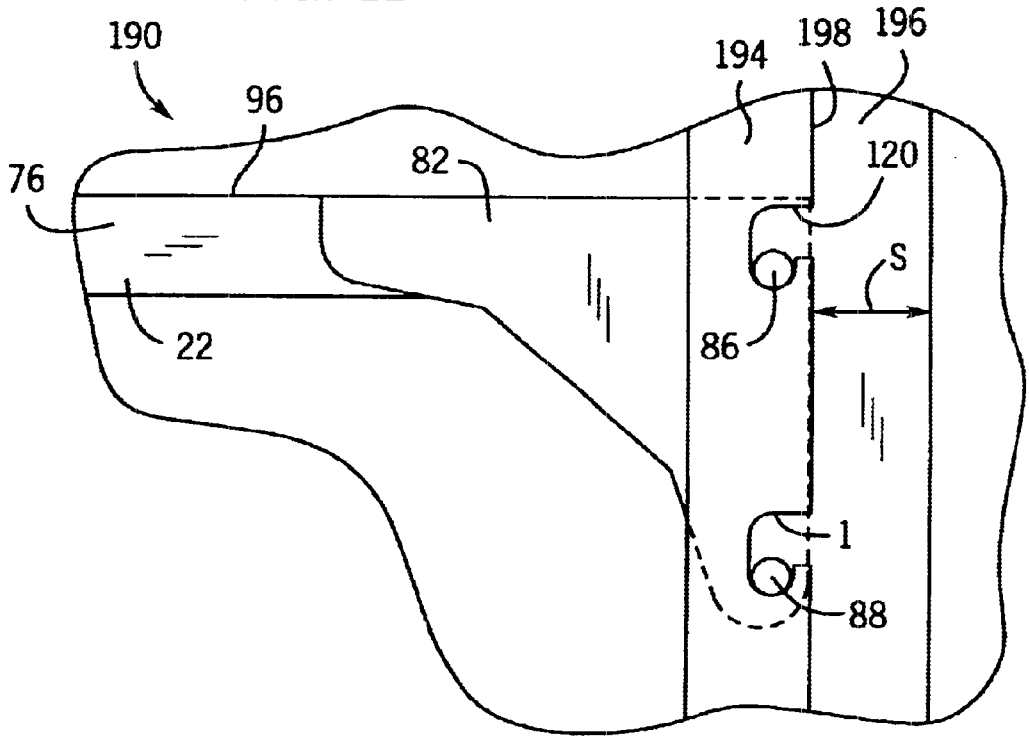
FIG. 11 is a view similar to that of FIG. 7, albeit of yet another embodiment of the present invention.

Referring now to FIG. 11, yet another embodiment of the present invention is illustrated. In this embodiment 190, the shelf assembly 22 is essentially identical to shelf assembly 22 described above with respect to the first embodiment and therefore, that assembly will not be described again here in detail. With respect to the frame member 194, however, that member is slightly different than member 14 described above. To this end, the difference between frame member 194 and member 14 is that frame member 194 is essentially turned around and would be separated from a back wall member 196 so that a space S exists between wall member 196 and a frame member receiving surface 198. Any manner may be used to secure frame member 194 adjacent wall member 196. For example, brackets (not illustrated) at the top and bottom ends of frame member 194 may be provided to maintain space S. Space S must be at least as wide as the widest of pins 86 and 88.

Frame member 194 forms first and second slot delineators 120*d* and 120*e* that open from receiving edge 198 in a direction opposite wall member 196. Delineators 120*d* and 120*e* are essentially identical to the delineators (e.g., 56*a*) described above with respect to the first embodiment and therefore, will not be described here again in detail.

In the case of embodiment 190, to mount shelf assembly 22 between two frame members (e.g., 194 and another similar frame member), a system user would manipulate shelf assembly 22 until the pins (e.g., 86 and 88) extending from both lateral edges of the assembly are within spaces S between wall member 196 and corresponding frame members 194. Next, the user would align pins 88 and 86 with the openings of delineators 120*d* and 120*e* and then pull the shelf assembly 22 forward until pins 86 and 88 are received within the delineators 120*d* and 120*e*, respectively. Lowering shelf assembly 22, pins 86 and 88 are then received within the recessed distal portions of the delineators and shelf assembly 22 is in a supported position.

It should be appreciated that embodiment 190 of the invention has a particularly finished appearance as assembly 190 would generally be observed from the shelf side of frame member 194 opposite wall member 196. In this case, the openings of the delineators 120*d* and 120*e* would not be readily observable and the assembly would be relatively aesthetically pleasing.

Figure 12:
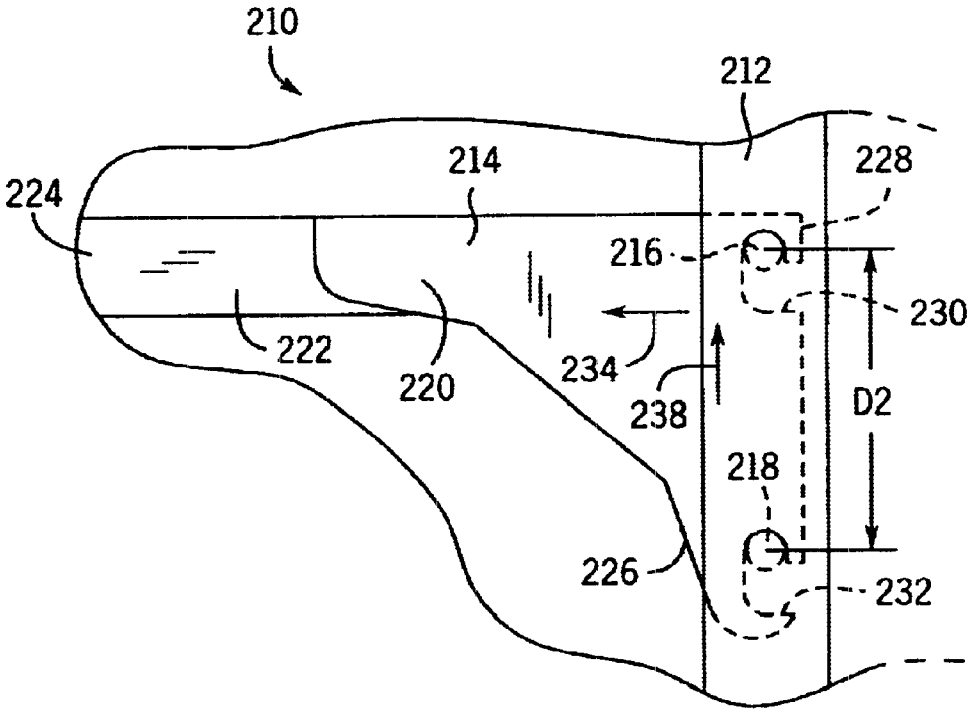
FIG. 12 is a view similar to that of FIG. 7, albeit of yet one more embodiment of the present invention.

Referring now to FIG. 12, yet one other embodiment 210 of the invention is illustrated. In embodiment 210, frame members (e.g., 212) include extending pins while a brace member 214 forms slot delineators. To this end, frame member 212 includes a plurality of pins, two of which are identified by numerals 216 and 218. The pins 216 and 218 are equally spaced along the length of upright frame member 212 and pin axis define a second dimension D2 as illustrated. Brace member 214 again includes one extending section 220 that, when brace member 214 is secured to a shelf member 222, extends at least in part along a lateral edge 224 of the shelf member 222. In addition, brace member 214 includes a second extending member 226 that is integrally attached to member 220 extending therefrom and forming a right angle therewith. Along a shelf member receiving edge 228, extending member 226 forms first and second slot delineators 230 and 232 that open from edge 228 toward distal ends of passageways along a first direction identified by arrow 234. At the distal ends of their respective passageways, the delineators 230 and 232 recess upwardly in a second direction perpendicular to first direction 234 and identified by arrow 238.

As with the other embodiments described above, the pins 216 and 218 and slot delineators 230 and 232 form bearing surfaces that bear against each other when the shelf assembly 222 is mounted to the frame members 212 to maintain the shelf assembly 222 in a supported position as illustrated.

To mount assembly 222 between two frame members 212, a system user grasps a front end (not illustrated in FIG. 12) of shelf assembly 222 and holds assembly in an essentially horizontal position with the openings of the delineators 230 and 232 facing pins 216 and 219 and with member 226 extending downward. The user then moves shelf assembly 222 rearward so that pins 216 and 218 pass into the passageways formed by delineators 216 and 218 until the pins 216 and 218 are at the distal ends of respective delineators 230 and 232. Next, the user lowers assembly 222 so that pins 216 and 218 are received within the upward recesses of delineators 216 and 218 as illustrated. When released, delineator bearing surfaces bear against pin bearing surfaces and maintain assembly 222 in the horizontal position. Assembly 222 is removed from frame members 212 by reversing the process described above.

It should be appreciated that the present invention provides a simple to manufacture, elegant, sturdy, aesthetically pleasing and relatively inexpensive shelving assembly. Specifically, the relatively thin frame members required to support the shelf assemblies constitute a minimal portion of the entire assembly appearance, and are also relatively easy and inexpensive to manufacture. In addition, because the frame members only extend a very short distance along the rear portions of the lateral edges of the shelf assemblies, the frame members only minimally obstruct access to storage space on top of each shelf. Aesthetics are particularly advantageous in the case of assemblies where brace members extend below shelf members (e.g., See FIGS. 5–7) as the brace members are then essentially hidden and in the case of assemblies where frame member delineators open in a direction opposite the direction in which a mounted shelf extends.

Moreover, it should be appreciated that a single shelf assembly may be mounted to opposing frame members in any of several different ways to modify assembly appearance. For instance, referring to FIGS. 7 and 10, shelf assembly 22 in FIG. 7 may be removed from frame members 12, 14 (See also FIG. 1), flipped over, and then mounted in an "upside down" position like the shelf assembly 1 and 2 of FIG. 10. This may be advantageous where opposite shelf surfaces (e.g., 76 and 79 in FIG. 5) have different appearances and simply flipping the shelves can change appearance.

As another instance, referring to FIG. 11 and again to FIG. 7, where space S is relatively large (e.g., where frame members 194 are secured to a ceiling away from all walls), shelf assembly 22 may be positioned as illustrated. In the alternative, shelf assembly 22 may be dismounted and turned through 180° so that surface 96 still faces upward but with member 76 extending in the opposite direction (i.e., to the right in FIG. 11) and on the opposite side of frame member 194. Then, assembly 22 may be remounted to frame member 194, this time in a manner similar to that illustrated in FIG. 7. Similarly, where frame members 194 are spaced away from all walls, some shelf assemblies 22 may be mounted to the frame members as illustrated in FIG. 7 while others are mounted as illustrated in FIG. 11.

Furthermore, it should be appreciated that any shelf assembly 22 can be mounted in any of several different positions along the vertical lengths of frame members 12 and 14 and that movement among vertical positions is extremely quick and easy.

It should be understood that the methods and apparatuses described above are only exemplary and do not limit the scope of the invention, and that various modifications could be made by those skilled in the art that would fall under the scope of the invention. For example, while each embodiment is illustrated as including identical annular or cylindrically shaped pins (e.g., 86, 88), in some embodiments, the pins may be different. Where the pins are different, note that the widths of the passageways must be sufficient to accommodate movement of corresponding pins therethrough. In addition, referring to FIG. 8, members 148 and 150 may be removed and frame member 130 would still operated as described above.

Also, while center frame member 130 is illustrated as being formed from a punched (i.e., to form the delineators) and then bent (i.e., to form separate walls of the frame member) steel ribbon, it should be appreciated that end frame members like the one illustrated in FIG. 3 may also be constructed in this manner to provide a relatively inexpensive and yet sturdy frame member. To this end, referring to FIGS. 13 through 15, a particularly advantageous embodiment of end frame member 300 is illustrated that includes a top end 301, a receiving edge wall 303 (forming a receiving edge), a delineator wall 304 and a rear wall 306. Walls 302 and 306 are essentially parallel and wall 304 traverses the distance between proximate ends of walls 302 and 306. In other words, wall 304 has first and second edges and walls 302 and 306 are linked to the first and second edges, respectively. Walls 302, 304 and 306 are integral and are formed by bending a steel ribbon along two lines to form right angles. Prior to bending, however, essentially L-shaped apertures 308*a*, 308*b*, etc., are formed (e.g. punched) along the length of the ribbon proximate one edge 310 that is nearest the receiving wall 302. Each L-shaped aperture 308*a*, etc., includes a passage segment 312 and a supporting segment 314. The passage segment 312 begins proximate the one edge 310 and extends approximately halfway toward the opposite edge. The supporting segment 314 (i.e., the second part of each L-shaped aperture) extends from a distal end of passage segment 312 toward a bottom end opposite top end 301. After apertures 308*a*, etc., have been formed, a first bend is made along a line 316 that passes through each of segments 312 approximately halfway along the length thereof. Thus, a portion of aperture 308*a* (and other similar apertures) is open along the surface of receiving wall 302 and a portion of aperture 308*a* is open along the surface of wall 304. The second bend is then formed along another line 320 proximate apertures 308*a*, etc. This construction is light weight, inexpensive, sturdy and elegant.

To apprise the public of the scope of this invention, the following claims are made.

What is claimed is:

1. A shelving assembly comprising:

at least one shelf member that forms a back edge along a longitudinal axis, forms at least a first lateral edge and includes oppositely facing first and second shelf surfaces, the back edge being a shelf member receiving edge;

at least one essentially upright support member including a support member receiving edge;

a first coupler pair including first and second couplers mounted to the shelf member, the first and second couplers mounted such that the couplers are aligned along a coupler axis that is essentially perpendicular to the shelf surfaces and such that the first and second couplers are proximate the shelf member receiving edge;

a second coupler pair including third and fourth couplers linked to the support member, the third coupler positioned essentially directly above the fourth coupler;

one of the coupler pairs including first and second pins and the other of the coupler pairs including first and second slot delineators, the first and second pins formed about first and second pin axis and forming first and second bearing surfaces, respectively, the pin axis defining a first dimension there between, each delineator forming a passageway that opens in a first direction from an opening at the corresponding member's receiving edge to a distal end, the distal ends of the first and second delineators recessing in a second direction perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through, the first coupler pair bearing surfaces within a coupling plane;

wherein, the shelf member is supportable by the support member with the first and second pins received in the first and second slot delineators, the first and second bearing surfaces contacting and bearing against the third and fourth bearing surfaces and the shelf surfaces essentially horizontally orientated.

2. The assembly of claim 1 wherein, with the shelf member mounted to the frame member, the passageways form paths perpendicular to the pin axis so that the shelf member is decouplable from the frame member by moving the shelf member in directions that are perpendicular to the pin axis.

3. The assembly of claim 1 wherein the first coupler pair includes the first and second pins, the second coupler pair includes the fist and second slot delineators and the passageways open from the receiving edge of the support member and recess downwardly at the distal ends.

4. The assembly of claim 3 wherein the shelf member further includes at least one brace member mounted to the lateral edge, extending perpendicular to one of the shelf surfaces and proximate the back edge and, wherein the first and second pins extend from the brace member.

5. The assembly of claim 4 wherein the first and second shelf surfaces are top and bottom surfaces, respectively, the top surface faces upward when the shelf member is mounted to the support member and the brace member extends from the bottom surface.

6. The assembly of claim 3 wherein the support member forms a plurality of slot delineators along a vertical length of the support member and adjacent slot delineators are equispaced along the vertical length.

7. The assembly of claim 3 wherein the slot delineators have essentially the same shape.

8. The assembly of claim 3 wherein the support member includes at least first and second essentially upright wall members that form an essentially right angle where the first wall member forms the receiving edge and the passageways extends into the second wall member, the first direction essentially perpendicular to the receiving edge.

9. The assembly of claim 8 wherein the first wall member includes first and second edges, the first and second wall members are linked at the first edge and the support member further includes at least a third wall member linked to the first wall member at the second edge, the third wall member extending from the first wall member in the first direction and opposing the second wall member.

10. The assembly of claim 9 wherein the third wall member forms an oppositely facing second coupler pair that is similar to the second coupler pair formed by the second wall member and that can be used to support a shelf member.

11. The assembly of claim 3 wherein, with the shelf member mounted to the support member, the shelf member extends from the support member in an extending direction and wherein the extending direction is opposite the first direction in which the passageway opens from the passageway opening to the distal end.

12. The assembly of claim 3 wherein, with the shelf member mounted to the support member, the shelf member extends from the support member in an extending direction and wherein the extending direction is the same as the first direction in which the passageway opens from the passageway opening to the distal end.

13. The assembly of claim 1 wherein the passageways are essentially identical and the recessed distal ends of the passageways are formed to receive the pins.

14. The assembly of claim 1 wherein the shelf member forms a second lateral edge opposite the first lateral edge and wherein the assembly further includes:

a complimentary first coupler pair including complimentary first and second couplers mounted to the second lateral edge, the complementary first coupler pair couplers mounted such that the couplers are aligned along a complimentary coupler axis that is essentially perpendicular to the shelf surfaces and such that the complimentary coupler pair couplers are proximate the receiving edge;

a complimentary support member opposite the at least one support member;

a complimentary second coupler pair including complimentary third and fourth couplers linked to the complimentary support member, the complimentary third coupler positioned essentially directly above the complimentary fourth coupler; and one of the complimentary coupler pairs including complimentary first and second pins and the other of the complimentary coupler pairs including complimentary first and second slot delineators, the complimentary first and second pins forming complimentary first and second bearing surfaces, each complimentary delineator forming a complimentary passageway that opens in the first direction from the corresponding member's receiving edge and extends to a distal end, the distal ends of the complimentary first and second delineators recessing in the second direction perpendicular to the first direction and defining complimentary third and fourth bearing surfaces, respectively, the complimentary first delineator passageway wide enough for the complimentary first pin to pass through and the complimentary second delineator passageway wide enough for the complimentary second pin to pass through;

wherein, the shelf member is supportable by the support members with the complimentary first and second pins received in the complimentary first and second slot delineators, the complimentary first and second bearing surfaces contacting and bearing against the complimentary third and fourth bearing surfaces and the support surfaces essentially horizontally orientated.

15. The assembly of claim 1 wherein the second coupler pair includes the first and second pins and the passageways open from the back edge of the shelf member and recess upwardly at the distal ends.

16. The assembly of claim 15 wherein the shelf member further includes at least one brace member mounted to the lateral edge, extending perpendicular to one of the support surfaces and proximate the back edge and, wherein the brace member forms the first and second slot delineators.

17. A support assembly comprising:

at least one supportable member that forms a back edge along a longitudinal axis, forms at least a first lateral end and includes oppositely facing first and second surfaces, the back edge being a supportable member receiving edge;

at least one essentially upright support member including a support member receiving edge;

a first coupler pair including first and second pins mounted to the supportable member, the first and second pins mounted such that the pins are aligned along a coupler axis that is essentially perpendicular to the support surfaces and such that the first and second couplers are proximate the supportable member receiving edge, the first and second pins formed about first and second pin axis and forming first and second bearing surfaces, respectively, the pin axis defining a first dimension there between;

a second coupler pair including first and second slot delineators, the first slot delineator positioned essentially directly above the second slot delineator, each delineator forming a passageway that opens in a first direction from an opening at the support member receiving edge to a distal end, the distal ends of the first and second delineators recessing downward in a second direction that is essentially perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through;

wherein, the supportable member is supportable by the support member with the first and second pins received in the first and second slot delineators respectively, the first and second bearing surfaces contacting and bearing against the third and fourth bearing surfaces, respectively, and the support surfaces essentially horizontally orientated.

18. The assembly of claim 17 wherein the supportable member forms a second lateral end opposite the first lateral end and wherein the assembly further includes:

a complimentary first coupler pair including complimentary first and second pins mounted to the second lateral end, the complimentary first and second pins mounted such that the pins are aligned along a complimentary coupler axis that is essentially perpendicular to the support surfaces and such that the complimentary first and second pins are proximate the supportable member receiving edge, the complimentary first and second pins formed about complimentary first and second pin axis and forming complimentary first and second bearing surfaces, respectively, the complimentary first and second pin axis also defining the first dimension there between;

a complimentary support member opposite the at least one support member; and a complimentary second coupler pair mounted to the complimentary support member, the complimentary second coupler pair including complimentary first and second slot delineators, the complimentary first slot delineator positioned essentially directly above the complimentary second slot delineator, each complimentary delineator forming a complimentary passageway that opens in the first direction from an opening at the complimentary support member receiving edge to a distal end, the distal ends of the complimentary first and second delineators recessing downward in the second direction that is essentially perpendicular to the first direction and defining complimentary third and fourth bearing surfaces, respectively, each complimentary passageway opening having a top edge, the top edges defining the second dimension, the complimentary first delineator passageway wide enough for the complimentary first pin to pass through and the complimentary second delineator passageway wide enough for the complimentary second pin to pass through;

wherein, the supportable member is supportable by the support members with the complimentary first and second pins received in the complimentary first and second slot delineators respectively, the complimentary first and second bearing surfaces contacting and bearing against the complimentary third and fourth bearing surfaces, respectively, and the support surfaces essentially horizontally orientated.

19. The assembly of claim 17 wherein the supportable member is a bar.

20. The assembly of claim 17 wherein the supportable member is a shelf member.

21. The assembly of claim 17 wherein, with the supportable member mounted to the frame member, the passageways form paths perpendicular to the pin axis so that the supportable member is decouplable from the frame member by moving the supportable member in directions that are perpendicular to the pin axis.

22. A support assembly for use with at least one supportable member that forms a back edge along a longitudinal axis, forms at least a first lateral end and includes oppositely facing first and second surfaces, the back edge being a supportable member receiving edge, a first coupler pair including first and second pins mounted to the supportable member, the first and second pins mounted such that the pins are aligned along a coupler axis that is essentially perpendicular to the support surfaces and such that the first and second couplers are proximate the supportable member receiving edge, the first and second pins formed about first and second pin axis and forming first and second bearing surfaces, respectively, the pin axis defining a first dimension there between, the assembly comprising:

at least one essentially upright support member including a support member receiving edge;

a second coupler pair including first and second slot delineators, the first slot delineator positioned essentially directly above the second slot delineator, each delineator forming a passageway that opens in a first direction from an opening at the support member receiving edge to a distal end, the distal ends of the first and second delineators recessing downward in a second direction that is essentially perpendicular to the first direction and defining third and fourth bearing surfaces, respectively, each passageway opening having a top edge, the top edges defining a second dimension essentially identical to the first dimension, the first delineator passageway wide enough for the first pin to pass through and the second delineator passageway wide enough for the second pin to pass through;

wherein, the supportable member is supportable by the support member with the first and second pins received in the first and second slot delineators respectively, the first and second bearing surfaces contacting and bearing against the third and fourth bearing surfaces, respectively, and the support surfaces essentially horizontally orientated.

23. The assembly of claim 22 also for use where the supportable member forms a second lateral end opposite the first lateral end and with a complimentary first coupler pair including complimentary first and second pins mounted to the second lateral end, the complimentary first and second pins mounted such that the pins are aligned along a complimentary coupler axis that is essentially perpendicular to the support surfaces and such that the complimentary first and second pins are proximate the supportable member receiving edge, the complimentary first and second pins formed about complimentary first and second pin axis and forming complimentary first and second pin axis and forming complimentary first and second bearing surfaces, respectively, the complimentary pin axis also defining the first dimension there between, the assembly further including:

a complimentary support member opposite the first support member;

a complimentary second coupler pair mounted to the complimentary support member, the complimentary second coupler pair including complimentary first and second slot delineators, the complimentary first slot delineator positioned essentially directly above the complimentary second slot delineator, each complimentary delineator forming a complimentary passageway that opens in the first direction from an opening at the complimentary support member receiving edge to a distal end, the distal ends of the complimentary first and second delineators recessing downward in the second direction that is essentially perpendicular to the first direction and defining complimentary third and fourth bearing surfaces, respectively, each complimentary passageway opening having a top edge, the top edges defining the second dimension, the complimentary first delineator passageway wide enough for the complimentary first pin to pass through and the complimentary second delineator passageway wide enough for the complimentary second pin to pass through;

wherein, the supportable member is supportable by the support members with the complimentary first and second pins received in the complimentary first and second slot delineators respectively, the complimentary first and second bearing surfaces contacting and bearing against the complimentary third and fourth bearing surfaces, respectively, and the support surfaces essentially horizontally orientated.

24. The assembly of claim 16 wherein the first and second support surfaces are top and bottom surfaces, respectively, the top surface faces upward when the shelf member is mounted to the support member and the brace member extends from the bottom surface.

* * * * *